US010153060B2

(12) United States Patent
Haunschild

(10) Patent No.: US 10,153,060 B2
(45) Date of Patent: Dec. 11, 2018

(54) BEAM SHUTTER, IN PARTICULAR FOR X-RAYS

(71) Applicant: Smiths Heimann GMBH, Wiesbaden (DE)

(72) Inventor: Norbert Haunschild, Aarbergen-Hausen (DE)

(73) Assignee: SMITHS HEIMANN GMBH, Wiesbaden (DE)

( * ) Notice: Subject to any disclaimer, the term of this patent is extended or adjusted under 35 U.S.C. 154(b) by 275 days.

(21) Appl. No.: 14/903,951

(22) PCT Filed: Jul. 9, 2014

(86) PCT No.: PCT/EP2014/064716
§ 371 (c)(1),
(2) Date: Jan. 8, 2016

(87) PCT Pub. No.: WO2015/004185
PCT Pub. Date: Jan. 15, 2015

(65) Prior Publication Data

US 2016/0211044 A1 Jul. 21, 2016

(30) Foreign Application Priority Data

Jul. 10, 2013 (DE) ..... 10 2013 107 310

(51) Int. Cl.
*G21K 1/00* (2006.01)
*G21K 1/04* (2006.01)

(52) U.S. Cl.
CPC ..... *G21K 1/04* (2013.01)

(58) Field of Classification Search
CPC ..... G01V 5/0016; G21K 1/04
See application file for complete search history.

(56) References Cited

U.S. PATENT DOCUMENTS 4,071,771 A * 1/1978 Covic ..... A61B 6/06 378/160
4,286,856 A 9/1981 Grath
(Continued)

FOREIGN PATENT DOCUMENTS

DE 202011102861 U1 1/2012

OTHER PUBLICATIONS

International Search Report dated Sep. 12, 2014 for PCT/EP2014/064716.

*Primary Examiner* — Dani Fox
(74) *Attorney, Agent, or Firm* — Kevin E. West; Advent, LLP

(57) ABSTRACT

The present disclosure relates to a device for closing and opening a beam path of electromagnetic and/or ionizing radiation, comprising at least one part of a shutter body which is permanently situated in the beam path and rotatable about a longitudinal axis situated essentially transversely with respect to the beam path, and which contains a material that is opaque to the radiation and blocks the beam path when the shutter body is in a closed rotary position, and which defines a passage that is transparent to the radiation when in an open rotary position; and comprising a magnetic drive which is coupled to the shutter body for rotation of same about the longitudinal axis between the rotary positions. The magnetic drive is an electromagnetic drive, and is configured for moving the shutter body between the rotary positions, wherein at least one of the rotary positions corresponds to a stable position of the magnetic drive which maintains the magnetic drive without current.

9 Claims, 3 Drawing Sheets

(56) References Cited

U.S. PATENT DOCUMENTS

| | | | | | |
|---|---|---|---|---|---|
| 5,054,041 | A | | 10/1991 | Hampel | |
| 5,107,530 | A | | 4/1992 | Allison | |
| 5,384,661 | A | * | 1/1995 | Geyer | B64D 47/08<br>359/236 |

* cited by examiner

BEAM SHUTTER, IN PARTICULAR FOR X-RAYS

TECHNICAL FIELD

The present disclosure relates in general to a device for closing or opening a beam path for electromagnetic or ionizing radiation. The present disclosure relates in particular to a shutter device comprising a rotatable shutter body having a rotational axis that is situated essentially transversely with respect to the beam path.

BACKGROUND

Some X-ray shutters are capable of terminating the exposure of an object to X-rays, for the case that the capacities of power supply cables to an X-ray tube still supply current or power to the X-ray tube, even after a programmed exposure time. For this purpose, an exposure controller is connected to a first solenoid which, prior to or during the excitation of the X-ray tube, pulls a radiopaque shutter slide made of lead, tungsten, or uranium against the tensile force of a spring into an open position in which the shutter is held by means of a detent latch of a second, de-energized solenoid. In the open position, a radiation window in the shutter allows X-rays to pass through. After a controller has initiated generation of the X-ray radiation, and as soon as a sensor detects a preset irradiation threshold value, the controller excites the de-energized solenoid, which removes the detent latch from the shutter. The mass of the shutter and the force of the spring are selected in such a way that the shutter may be moved from the open position into a closed position in approximately 1/5000 second in order to rapidly interrupt the X-ray radiation.

A problem with the known shutter devices, in which the shuttering of the beam path takes place by means of a slide which is introduced in a direction transverse to the beam path, is that the spring responsible for the required rapid actuation of the shutter may fatigue or break over time. In addition, the system comprising the spring, slide, and detent latch is complex, and due to the linear motion of the slide requires a relatively large installation space. To be able to keep the size of the slide, and thus its mass, small, it must be situated close to the radiation source, since at that location the cross-sectional surface of the radiation to be shuttered is small. Lastly, for the spring-actuated linear motion of the slide, a damping means is necessary in order to avoid rebound of the slide at the end position, so that ultimately, the dimensioning of the spring, slide, and damping element always represents a compromise solution.

Some rotary shutters are shiftable between a first position in which an X-ray beam path is blocked, and a second position in which the X-ray beam path is open. A closed position indicator having optical sensors can detect a reliable rotation of the rotary shutter into the first or second position, by means of a magnetic drive. The known rotary shutter and the control of the position of the shutter are complex.

SUMMARY

The present disclosure relates to a shutter device and a method for opening and closing the beam path of electromagnetic and/or ionizing radiation, having a simple design.

The core concept of the present disclosure is that, instead of a slide which is to be linearly moved into the beam path via a magnetic drive, a rotatable shutter body is used as a drive means for rotating the shutter body between a closed rotary position in which the beam path is closed, and an open rotary position in which the beam path is open for the radiation. In the present context, "open" basically means that in the open rotary position, the shutter body in this position is transparent to the radiation to be used, i.e., is permeable at least for a certain frequency or wavelength range of the radiation; that is, in principle, material of the shutter body may also be present in the beam, which then, however, is transparent or permeable to the radiation or at least a portion thereof.

According to a first aspect of the present disclosure, a device for closing and opening a beam path of electromagnetic and/or ionizing radiation comprises: a shutter body which is permanently situated in the beam path and rotatable about a longitudinal axis situated essentially transversely with respect to the beam path which contains a material that is opaque to the radiation, and which closes the beam path in a closed rotary position, and a passage that is transparent to the radiation in an open rotary position. For example, compared to known slide or diaphragm systems, in which one (or multiple) shutter element(s) is/are translationally moved from a (or different) direction(s) into the beam path, the shutter element according to the present disclosure is permanently situated in the beam path, and has two rotary positions, namely, the closed rotary position in which the shutter element closes the beam path, i.e., seals off or blocks the radiation, and the open rotary position in which the radiation, or at least a portion thereof, may pass through the shutter body essentially unhindered. In addition, the shutter device has a magnetic drive which is coupled to the shutter body for rotation thereof about the longitudinal axis, between the two rotary positions. As the magnetic drive, an electromagnetic drive is provided which is configured for moving the shutter body between the two rotary positions. At least one of the two rotary positions corresponds to a stable position of the magnetic drive which is able to hold/maintain the magnetic drive without current.

According to a second aspect of the present disclosure, a method for opening and closing a beam path for electromagnetic and/or ionizing radiation comprises the following steps:

- rotating a part of a shutter body which is permanently situated in the beam path and rotatable about a longitudinal axis situated essentially transversely with respect to the beam path, and which is made of a material that is opaque to the radiation, into an open rotary position, so that a passage which is formed in the shutter body and is transparent to the radiation is brought into alignment with the beam path.
- rotating the shutter body situated in the beam path into a closed rotary position, so that the beam path is closed by the material of the shutter body which is opaque to the radiation.
- carrying out the particular rotary motions of the shutter body between the rotary positions by means of an electromagnetic drive, and holding at least one of the rotary positions of the magnetic drive, without current, by means of a permanent magnet associated with this rotary position.

In the device according to the present disclosure and the method according to the present disclosure, particularly short switching times between the two shutter states may be achieved when the rotationally actuated shutter body and the electromagnetic drive are combined.

Features and details which are described below in conjunction with the shutter device according to the present disclosure for closing and opening a beam path of electromagnetic and/or ionizing radiation naturally apply also in conjunction with the above method according to the present disclosure, and vice versa, so that with regard to the disclosure of the individual features of the present disclosure, reciprocal reference is or may be made here.

In a first embodiment of the shutter device, the magnetic drive may be a monostable electromagnetic drive, i.e., may have one stable position. The shutter device may be configured in such a way that a predetermined end rotary position of the shutter body corresponds to the stable position of the magnetic drive.

For example, the magnetic drive may hold/maintain the predetermined end position without current, i.e., without supplying electrical power, by means of a permanent magnet installed for this purpose.

When the predetermined rotary position is the closed rotary position, one aspect of the embodiment concerns radiation safety, since the beam path is only actively open, i.e., must be held open. This means that in the event of a malfunction, solely by interrupting the power supply to the magnetic drive it may be ensured that the shutter device assumes the closed rotary position, and thus blocks the beam path. noted that the actual closing operation then takes place without current, i.e., without supplying external power.

In a second alternative embodiment of the shutter device, the magnetic drive may be a bistable electromagnetic drive, i.e., may have two stable positions. The shutter device may be configured in such a way that each of the two (functional) rotary positions of the shutter body corresponds to one of two stable positions of the magnetic drive which may hold/maintain the magnetic drive without current.

Thus, in the bistable embodiment, the magnetic drive may in each case hold/maintain one of two predetermined end positions, without current, for example in each case by means of a permanent magnet installed for this purpose. There may be an unstable equilibrium point between the structure-related stable end positions, wherein the drive is automatically moved from the equilibrium point into the closest stable end position when appropriately controlled or deflected.

It is noted here that this embodiment of the shutter device does not have significant power requirements, since the electromagnetic drive need be supplied with electrical energy only briefly for rotating the shutter means. Due to the operating phases for the electromagnetic drive, which are brief in each case, the electromagnetic drive may be operated in this overload range in order to achieve maximum acceleration. It has been shown that the time between the movements or operating phases is sufficient for cooling the magnetic drive; i.e., although the drive becomes warm during the temporary overload in the operating phase, it stays below the specified upper temperature limit. Therefore, with regard to the site of installation, there are essentially no special limitations concerning the heat dissipation to be ensured.

The magnetic drive may be an electric solenoid drive, but may also be a linear magnetic drive; if a linear magnetic drive is used, the linear motion may be converted into the required rotary motion, (i.e., rotation of the shutter body via a lever mechanism).

The electromagnetic drives which are preferred for the shutter device may be based essentially on the following basic design principle. A wound coil made of copper wire, for example, together with an open iron core forms an electromagnet with which mechanical work in the form of motion may be performed or a retaining force may be generated when electric current flows through the coil. As a linear drive, the magnetic drive is designed in such a way that when current is flowing, an armature undergoes a linear lifting motion. Depending on the design, when current is flowing, the lifting motion of the armature may push, pull, or also both, starting from a central position. As a rotary drive, the magnetic drive is configured in such a way that when current is flowing through the coil, the armature generates a purely rotational motion, similar to a drive shaft in an electric motor. In contrast to the electric motor, the armature of the solenoid drive is not able to rotate continuously, but, rather, is able to rotate only over a predetermined rotational angle; the rotary motion may take place in the clockwise direction, in the counterclockwise direction, or also in both directions, in that case starting from a central position.

The shutter body may be installed, for example, in a device for shaping the radiation. Such a shaping device may be a collimator. In other implementations, the shutter body may be situated directly on the housing of a device for generating the radiation. Such a radiation generation device may be, for example, an X-ray tube for generating X-rays.

The shutter body may be shaped in such a way that inner surfaces of the passage directed toward the beam path in the open rotary position may be designed or may extend in such a way that they essentially align with housing surfaces (i.e., inner housing surfaces), which delimit the beam path, or do not restrict the free cross section of the beam path. Alternatively, the desired free cross section of the beam path may be defined by the passage, i.e., the inner surfaces facing the beam path, or, for the case that the shutter body is made of various materials, a partial area containing material that is opaque to the radiation and a partial area containing material that is transparent at least to a portion of the radiation; the boundary surfaces thus defined determine the effective cross section of the beam path.

In certain embodiments, the shutter body may have essentially or approximately the shape of a half-cylinder or cylindrical section, at least in the area or portion that is permanently situated in the beam path.

In certain embodiments, the shutter body may have essentially or approximately the shape of a solid cylinder, at least in the area or portion that is situated in the beam path, wherein the passage may be a slit or window in the shutter body which extends transversely with respect to the longitudinal axis.

In one embodiment, the passage may be defined by the absence of any material in the shutter body; i.e., the passage in the shutter body may have a material-free design.

Alternatively, the passage in the shutter body may be defined or formed by an appropriately shaped material which is integrated into the shutter body and which is transparent to the radiation. In this variant, the shutter body may thus be inserted into a device, which defines the beam path, in such a way that the shutter additionally hermetically seals the beam path.

The above embodiment may be refined by defining or forming the passage in the shutter body using an appropriately shaped filter material which is integrated into the shutter body, the filter material being selected in such a way that the X-rays passing through are filtered in a targeted manner.

For example, the filter material may be selected in such a way that the X-ray radiation is hardened in a defined manner. In the present context, "hardened" means that low-energy X-ray quanta are absorbed by the filter material, and X-ray quanta with high energy pass through to the greatest possible extent. In other words, the X-rays which are "softer," i.e., have a longer wavelength and less penetrating power, are filtered out. In these implementations, the filter material may comprise aluminum, copper, or the like. Furthermore, it is also possible to filter out additionally determined "hard" X-rays, i.e., short-wave and thus high-energy portions of the X-ray radiation spectrum. For example, a material having a fairly high atomic number, such as zirconium, molybdenum, rhodium, or the like, can be used as a filter material.

The shutter body and/or the magnetic drive may be mechanically configured in such a way that only one motion in a predetermined range is possible. For example, end stops which are associated with the two (functional) rotary positions (open/closed rotary position) may be provided on the shutter body and/or the drive means, so that the shutter body or the drive means is mechanically movable only in a range defined by the end stops. The particular rotary position of the shutter body may thus be ensured in a particularly precise manner. In addition, elastic end stops may be provided which absorb the kinetic energy of the shutter body when one of the (functional) rotary positions is assumed.

The present disclosure is particularly suited as a shutter device for the beam path in an X-ray inspection system.

Depending on the design, the shutter device may be configured as a safety device, wherein a closed position of the shutter device is a monostable position in which the shutter body is automatically rotated when an energy supply (e.g., a power supply) necessary for holding the shutter body in the unstable open position is interrupted. This variant is particularly suitable, for example, when a permanent beam emitter or continuous beam emitter having a cobalt 60 radiation source, for example, and not an electrical X-ray tube, is used as the radiation source. The monostable shutter device may safeguard an automatic closure of the radiation source in the event of a power failure.

It is also possible to configure the shutter device in a bistable manner, wherein in each case the closed position as well as the open position of the shutter device is a stable position in which the shutter body is automatically held. An appropriate energy supply, for example a current pulse, can rotate the shutter body from one of the two positions into the other position.

BRIEF DESCRIPTION OF THE FIGURES OF THE DRAWING

Further advantages, features, and particulars of the present disclosure result from the following description, in which example embodiments of the present disclosure are described in detail with reference to the drawings. In this regard, the features mentioned in the claims and in the description, alone or in any arbitrary combination, may be essential to the present disclosure. Likewise, the features mentioned above as well as the features discussed in greater detail below may be used singly or in a plurality in any arbitrary combination. Functionally equivalent or identical parts or components are sometimes provided with the same reference numerals. The terms "left," "right," "top," and "bottom" used in the description of the example embodiments refer to the drawings in an orientation with a normally readable description of the figures or normally readable reference numerals. The embodiments shown and described are not to be construed as an exhaustive listing, and instead provide examples for the description of the present disclosure.

DETAILED DESCRIPTION

The present disclosure is described in detail below based on one an example embodiment, with reference to the figures. The detailed description is used for the information of those skilled in the art, and is not to be construed as limiting. Numerous specific particulars are set forth in the following description. However, it is understood that embodiments of the present disclosure may also be used without these specific particulars. Circuits, structures, and methods known to those skilled in the art are not addressed in detail here, in order to not unduly complicate the understanding of the present description.

The terms "coupled" and "connected/attached" as well as terms derived from same are not used synonymously here. Rather, in specific embodiments, "connected/attached" may indicate that two or more elements are in direct physical or electrical contact with one another. "Coupled" may mean that two or more elements cooperate or mutually influence one another, whereby they may be in direct, but also indirect, physical or electrical contact with one another. Unless stated otherwise, use of the ordinal adjectives "first," "second," "third," and so forth for denoting the same object merely indicates that reference is being made to various examples of similar objects, and is not intended to imply that the objects thus denoted must occur in a certain temporal, spatial, ranked, or other sequence.

Figure 1:
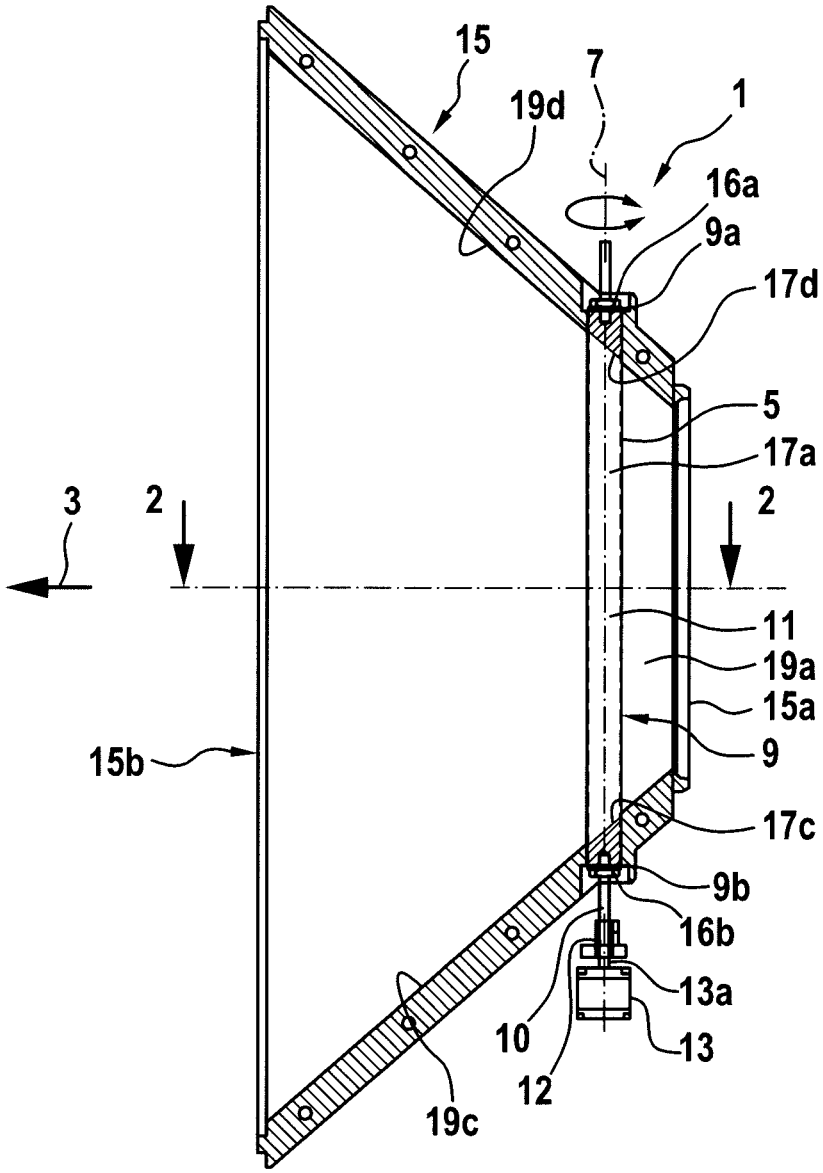
FIG. 1 shows a sectional view, from the top, of one example embodiment of a shutter device, which is integrated into a fan beam collimator.

FIG. 1 shows a sectional view, from the top, of one example embodiment of a shutter device 1 according to the present disclosure, which is integrated into a fan beam collimator 15, adjacent to a narrower end, for forming a fan-shaped X-ray bundle.

The fan beam collimator 15 in the embodiment illustrated here is made up essentially of two congruent trapezoidal halves, each having a small side 15*a* and a large side 15*b*. In the assembled state, the halves form a beam path 3 for X-rays generated in an X-ray radiation source (not shown) coupled to the small side 15*a*. The X-rays are irradiated into the beam path 3 at the small side 15*a* of the collimator 15, and exit the beam path at the large side 15*b* of the collimator, in an angular range that is defined by the collimator.

It is noted that the housing of the fan beam collimator 15 does not necessarily have to be composed of two halves. For example, the housing may also have a one-part or one-piece design, i.e., may be a one-piece cast part, for example, which has an appropriately shaped and oriented recess, for example a matching borehole, for the shutter body.

A part 5 of a shutter body 9 is permanently situated in the beam path 3, adjacent to the small side 15*a*. The shutter body 9 is rotatably supported in the collimator 15 so that at its longitudinal ends 9*a*, 9*b*, the shutter body is rotatable about a longitudinal axis 7 extending essentially transversely with respect to the beam path 3, via bearing means 16*a*, 16*b* known as such.

The shutter body 9 itself, i.e., the part that is used for closing the beam path 3, is made of a material that is opaque to X-ray radiation, for example lead, tungsten, uranium, or tantalum; instead of tantalum, niobium or zirconium or an alloy composed of 80% to 90% tantalum, niobium, and zirconium may also be used. Alternatively, gold, ceramic, sintered materials made of tungsten together with copper, nickel, and/or iron or the like, to name a few additional examples, are also suitable.

The material of the housing parts or of the housing of the collimator 15 is likewise made of a material that is opaque to X-ray radiation, which may likewise be the elements mentioned with regard to the shutter body 9, or alternatively may be steel or brass.

Figure 2A:
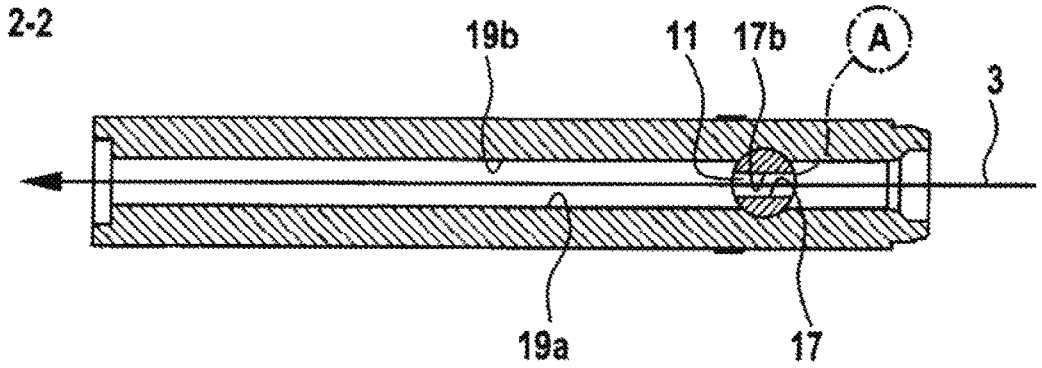
FIG. 2*a* shows a sectional view 2-2 of FIG. 1, in which the shutter means of the shutter device opens the beam path.
Figure 3A:
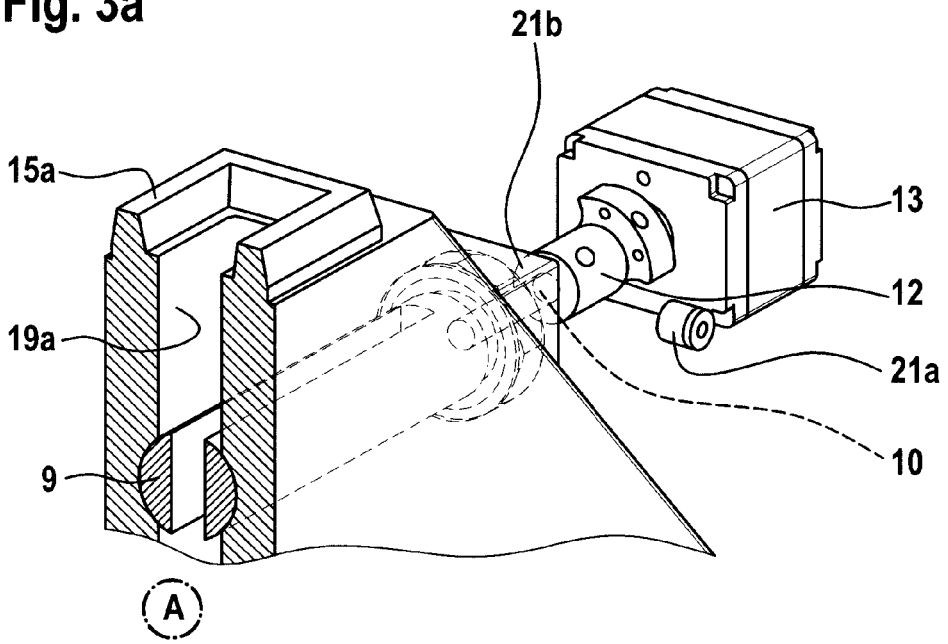
FIG. 3*a* shows a perspective view of a detail of the shutter device from FIG. 1, in which the shutter body is in the open rotary position.

The shutter body 9 is shaped in such a way that a passage 11 that is transparent to the X-ray radiation is defined by means of the shutter body 9 in an open rotary position A (FIGS. 2*a*, 3*a*). In this regard, FIG. 2*a* shows a sectional view 2-2 of FIG. 1, in which the shutter means of the shutter device opens the beam path. FIG. 3*a* shows a perspective view of a detail of the shutter device from FIG. 1, in which the shutter body is in the open rotary position A.

More precisely, the part of the shutter body 9 which is made of the material that is opaque to X-ray radiation essentially has the shape of a solid cylinder. The passage 11 extends radially or centrally through the shutter body 9 with respect to the longitudinal axis 7 corresponding to the rotational axis. As is apparent in part with reference to FIGS. 3*a*, 3*b*, the passage 11 has a rectangular cross section in the main direction of the beam path 3.

In the open rotary position A, inner surfaces 17*a*, 17*b*, 17*c*, 17*d* of the passage 11 which are directed toward the beam path 3 are oriented in such a way that they are aligned with inner housing surfaces 19*a*, 19*b*, 19*c*, 19*d* of the fan beam collimator 15 which delimit the beam path 3 (surfaces 17*c*, 17*d*) or which define the free cross section of the beam path 3 (surfaces 17*a*, 17*b*).

Figure 2B:
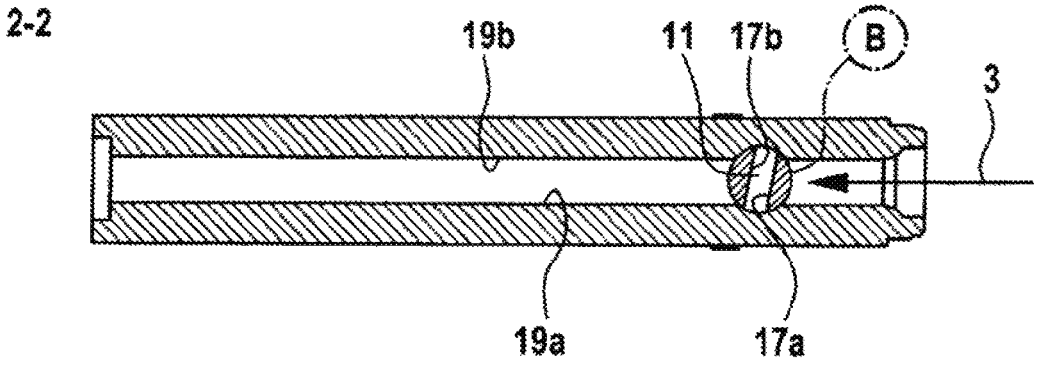
FIG. 2*b* shows a sectional view 2-2 of FIG. 1, in which the shutter means of the shutter device closes the beam path.
Figure 3B:
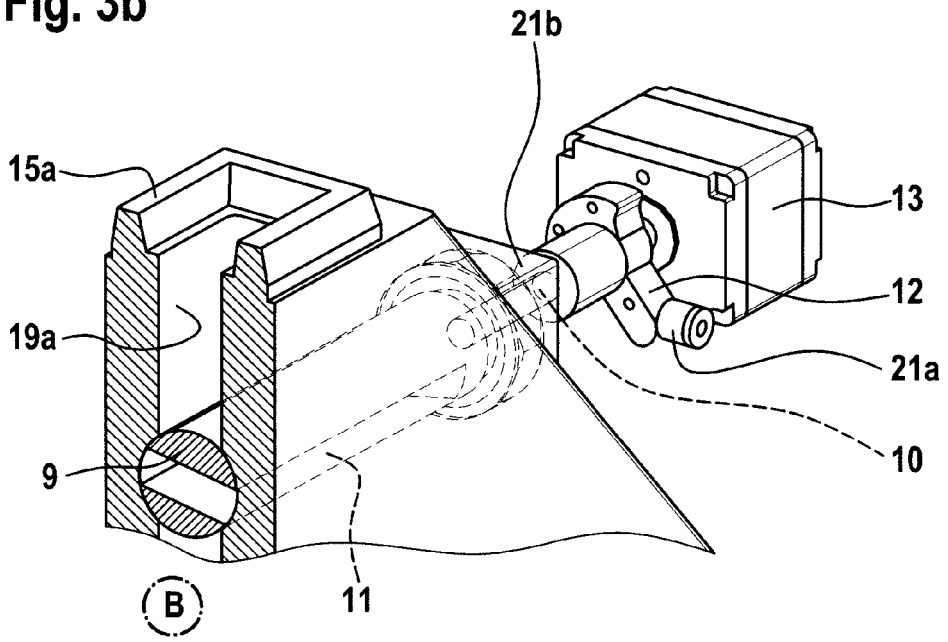
FIG. 3*b* shows a perspective view of a detail of the shutter device from FIG. 1, in which the shutter body is in the closed rotary position.

In addition, the shutter body 9 is shaped in such a way that in a closed rotary position B (FIGS. 2*b*, 3*b*) of the shutter body 9, the entire free cross section of the beam path 3 is blocked by means of the material that is opaque to X-ray radiation. In this regard, FIG. 2*b* shows a sectional view 2-2 from FIG. 1 in which the shutter body 9 completely closes the beam path. FIG. 3*b* shows a perspective view of a detail of the shutter device from FIG. 1, in which the shutter body is in the closed rotary position B.

A magnetic drive 13 is coupled via a shaft 10 to the shutter body 9 for rotation thereof about the longitudinal axis 7 between the rotary positions A, B. In the illustrated example embodiment, the magnetic drive 13 is a bistable electromagnetic drive having two stable end positions which in each case stably maintain the magnetic drive in a state without current, i.e., without supplying electrical energy in the form of electric current. For example, for this purpose at least two permanent magnets, by means of which the magnetic drive may be held in each case in a predetermined position without current, may be situated in the magnetic drive. Each of the two rotary positions A, B of the shutter body 9 is associated in each case with one of these two stable positions of the magnetic drive.

In the example embodiment shown, magnetic drive 13 is a bistable electric solenoid. This means that the magnetic drive 13 directly generates the rotary motion required for actuating the shutter device 1. Bistable solenoids have quick response times, and hold the particular predetermined stable position or end position without a power supply. Since electrical energy is needed only for the short time when the shutter device is actuated, bistable magnetic drives consume little energy, and due to the short operating phases have only minor heat loss.

A rotary stop element 12 in the form of a lever is fastened to the shaft 10 which couples the rotor 13*a* of the magnetic drive 13 to the shutter body 9. End stops 21*a*, 21*b* (the stop 21*b* is concealed in the illustration, but in principle has a design similar to the stop 21*a*) which are associated with the two rotary positions A, B are fixedly mounted on the housing of the magnetic drive 13 in such a way that the shutter body 9 and the magnetic drive 13 can be moved only in the angular range defined by the two end stops 21*a* and 21*b*, which essentially corresponds to a 90° rotation of the shutter body 9. End stops 21*a*, 21*b* are provided with an elastic material, for example an elastomer, for example a material such as rubber or a rubber-like material, i.e., a material having elastic properties similar to rubber, which absorbs the kinetic energy of the moved shutter body 9 when one of the rotary positions A, B is assumed.

In the de-energized state, there is an unstable equilibrium point in the center position between the two end stops 21*a* and 21*b*, each of which corresponds to one of the stable operating points of the magnetic drive in each rotational direction in which the rotor 13*a* automatically rotates as soon as it is deflected from this center position in the respective direction. The necessary torque is generated only by permanent magnets installed for this purpose in the magnetic drive. Since the end stops 21*a* and 21*b* are each situated approximately in front of the stable end positions of the rotor 13*a*, the rotor 13*a* remains in these end positions until it becomes active, i.e., as the result of supplying power is deflected beyond the center position toward the other end position.

The electromagnetic drive may be actuated, for example, via a bipolar amplifier, such as a bipolar stepping motor amplifier module. The magnetic drive may be controlled in each case between the rotary positions of the shutter body 9 via a current pulse, wherein the pulse length of the current corresponds to the movement time into the respective other rotary position of the shutter body 9.

A device 1 for closing and opening the beam path 3 for electromagnetic and/or ionizing radiation, namely, X-ray radiation, is explained with reference to the example embodiment described above. The present disclosure is not limited to the described example embodiment; rather, the scope of the present disclosure results from the claims which follow. The shutter device 1 comprises at least one part 5 of the shutter body 9 which is permanently situated in the beam path 3 and rotatable about a longitudinal axis 7 situated essentially transversely with respect to the beam path 3, and which contains a material that is opaque to the radiation and blocks the beam path 3 when the shutter body 9 is in the closed rotary position B, and which defines or forms a passage 11 that is transparent to the radiation when in the open rotary position A; and comprises a magnetic drive 13 which is coupled to the shutter body 9 for rotation of same about the longitudinal axis 7 between the rotary positions A, B, wherein the magnetic drive 13 is an electromagnetic drive and is configured for moving the shutter body 9 between the rotary positions A, B, wherein at least one of the rotary positions A, B corresponds to or is associated with a stable position of the magnetic drive which can maintain the magnetic drive without current.

The invention claimed is:

1. A device for closing and opening a beam path of electromagnetic and/or ionizing radiation, comprising:

at least one part of a shutter body which is permanently situated in the beam path and rotatable about a longitudinal axis situated essentially transversely with respect to the beam path, and which contains a material that is opaque to the radiation and blocks the beam path when the shutter body is in a closed rotary position, and which defines a passage that is transparent to the radiation when in an open rotary position, and wherein the at least one part of the shutter body hermetically seals the beam path;

a magnetic drive which is coupled to the shutter body for rotation of same about the longitudinal axis between the rotary positions the magnetic drive configured for moving the shutter body between the rotary positions, wherein at least one of the rotary positions corresponds to a stable position of the magnetic drive which maintains the magnetic drive without current, and wherein the magnetic drive comprises a bistable electric solenoid drive having two stable end positions; and at least two permanent magnets to hold the bistable electrical solenoid drive in a predetermined position without current, wherein the magnetic drive is operated in an overload range to achieve maximum acceleration.

2. The shutter device according to claim 1, wherein the magnetic drive is a solenoid drive or a linear magnetic drive.

3. The shutter device according to claim 1, wherein the shutter body is situated in a device for shaping the radiation, such as a collimator, or is situated on a device for generating the radiation, such as a X-ray tube.

4. The shutter device according to claim 1, wherein in the open rotary position, inner surfaces of the passage which are directed toward the beam path are designed in such a way that the inner surfaces are aligned with housing surfaces which delimit the beam path, do not limit the free cross section of the beam path, or define the free cross section of the beam path.

5. The shutter device according to claim 1 wherein the shutter body, at least in the area that is permanently situated in the beam path, has the shape of a half-cylinder or cylindrical section, or has the shape of a solid cylinder with the passage extending essentially radially through the shutter body.

6. The shutter device according to claim 5, wherein the passage extending essentially radially through the shutter body comprises a rectangular cross section.

7. The shutter device according to claim 1, wherein end stops associated with the two rotary positions are provided on the shutter body or the magnetic drive in such a way that the shutter body or the magnetic drive is movably only in a range defined by the stops, which essentially corresponds to a 90° rotation of the shutter body.

8. A method for opening and closing a beam path for electromagnetic and/or ionized radiation, comprising the following steps:

rotating a part of a shutter body which is permanently situated in the beam path and rotatable about a longitudinal axis situated essentially transversely with respect to the beam path, and which is made of a material that is opaque to the radiation, into an open rotary position, so that a passage which is formed in the shutter body and is transparent to the radiation is brought into alignment with the beam path, and wherein the part of the shutter body hermetically seals the beam path;

rotating the shutter body situated in the beam path into a closed rotary position, so that the beam path is closed by material of the shutter body which is opaque to the radiation; and carrying out the particular rotary motions of the shutter body between the rotary positions via a magnetic drive, and holding at least one of the rotary positions of the magnetic drive, without current, by means of a permanent magnet associated with this rotary position, and wherein the magnetic drive comprises a bistable electric solenoid drive having two stable end positions, wherein at least two permanent magnets hold the bistable electrical solenoid drive in a predetermined position without current, wherein the magnetic drive is operated in an overload range to achieve maximum acceleration.

9. An X-ray inspection system comprising an X-ray source, a shutter device according to claim 1, and a control device which is operatively connected to the shutter device and is configured for controlling the shutter device using the method according to claim 8.

* * * * *